US005830018A

United States Patent [19]

Simmel

[11] Patent Number: 5,830,018

[45] Date of Patent: Nov. 3, 1998

[54] LOW PROFILE SURFACE MOUNTABLE ELECTRICAL CONNECTOR ASSEMBLY

[75] Inventor: George M. Simmel, Singapore, Singapore

[73] Assignee: Molex Incorporated, Lisle, Ill.

[21] Appl. No.: 571,309

[22] Filed: Dec. 12, 1995

[51] Int. Cl.[6] ..... H01R 9/09

[52] U.S. Cl. ..... 439/660; 439/862

[58] Field of Search ..... 439/74, 660, 284, 439/295, 636, 637, 862

[56] References Cited

U.S. PATENT DOCUMENTS

| | | | |
|---|---|---|---|
| 4,113,179 | 9/1978 | McKee | 339/91 R |
| 4,188,086 | 2/1980 | Inouye et al. | 439/174 |
| 4,734,060 | 3/1988 | Kawawada et al. | 439/660 |
| 4,936,793 | 6/1990 | Uchida | 439/357 |
| 5,167,528 | 12/1992 | Nishiyama et al. | 439/489 |
| 5,181,855 | 1/1993 | Mosquera et al. | 439/74 |
| 5,192,232 | 3/1993 | Lenz et al. | 439/660 |
| 5,199,884 | 4/1993 | Kaufman et al. | 439/74 |
| 5,224,866 | 7/1993 | Nakamura et al. | 439/81 |
| 5,310,357 | 5/1994 | Olson | 439/346 |
| 5,433,616 | 7/1995 | Walden | 439/62 |
| 5,626,482 | 5/1997 | Chan et al. | 439/74 |

FOREIGN PATENT DOCUMENTS

| | | | |
|---|---|---|---|
| 6111894 | 4/1994 | Japan | H01R 23/68 |

*Primary Examiner*—Neil Abrams
*Assistant Examiner*—Christopher Goins
*Attorney, Agent, or Firm*—Stacey E. Caldwell

[57] ABSTRACT

A low profile electrical connector assembly includes plug and receptacle connectors having mating dielectric housings each mounting a plurality of terminals which include contact portions for interengagement with the contact portions of the terminals of the other connector. The terminals include mounting portions for surface connection to circuit traces on a pair of printed circuit boards. The receptacle terminals are generally U-shaped as defined by a first leg that is joined to the respective mounting portion of the terminal and a free spring contact leg that is engageable with the contact portion of one of the terminals of the other connector and which is preloaded on a shoulder of the receptacle housing. The first leg includes a proximal end fixed to the housing and a distal end movably supported therein to permit a portion of the first leg between the proximal end and the distal end to be flexibly movable into a slot in the housing during mating of the connectors.

10 Claims, 4 Drawing Sheets

LOW PROFILE SURFACE MOUNTABLE ELECTRICAL CONNECTOR ASSEMBLY

FIELD OF THE INVENTION

This invention generally relates to the art of electrical connectors and, particularly, to a low profile electrical connector assembly.

BACKGROUND OF THE INVENTION

Miniature or low profile electrical connectors are used extensively in applications wherein it is desirable to maintain the heights of the connectors as low as possible. For instance, miniature or low profile surface mount connectors are mounted on printed circuit boards within an electronic appliance where the space in which the connectors and circuit boards are housed is of a premium. This low profile of the connectors may cause a variety of problems.

One such problem in low profile surface mount connectors is that there is not always sufficient space or height available to provide sufficient contact beam length, and therefore beam deflection and contact normal forces may be compromised. Therefore, it has been necessary to design the terminals to increase the effective beam lengths thereof and to utilize expensive materials in fabricating such terminals which have adequate thickness and/or stiffness to provide sufficient normal force in the finished product. Furthermore, in board-to-board connector applications wherein no mechanical connections are provided except the frictional engagement between mating terminals, the possibility that the miniature or low profile connectors can be accidentally unmated by mechanical shock is significant. These considerations have necessitated incorporating increased frictional engagement between the terminals, thereby increasing the force required to disconnect the connectors. However, such increased frictional engagement between the mating terminals can result in excessive mating and unmating forces which, in turn, render the connector and/or the printed circuit board assembly susceptible to damage or breakage upon mating and unmating. Accordingly, it is important in these connector assemblies to provide a cost effective, simple terminal design, which allows for adequate deflection and normal force of the terminal during mating and unmating to both prevent premature or inadvertent disconnection and to allow for disconnection or unmating of the connector assemblies when required.

The present invention therefore is directed to providing an electrical connector assembly of the character described above that employs a terminal design which facilitates the miniaturization of the mating connectors and which provides for adequate beam deflection and sufficient normal force in the low profile space provided.

SUMMARY OF THE INVENTION

An object, therefore, of the invention is to provide a new and improved electrical connector assembly including a receptacle connector that lends itself to miniaturization and a low profile construction.

In the exemplary embodiment of the invention, the low profile electrical connector assembly includes a mating plug and a receptacle connector each having a dielectric housing mounting a plurality of terminals which themselves include contact portions for interengagement with the contact portions of the terminals of the other connector. The housing of each connector has opposite ends with a mounting face extending therebetween adapted for surface mounting to a surface of a printed circuit board. The terminals include mounting portions for surface connection to circuit traces on the printed circuit board. The terminals of at least one of the connectors include generally U-shaped contact portions each defined by a first leg that is joined to the respective mounting portion of the terminal and a free spring contact leg engageable with the contact portion of a corresponding terminal of the other connector. The first leg includes a proximal end fixed to the housing proximate the mounting portion of the terminal and a distal end opposite the proximal end movably supported along its edges to thereby allow the portion of the first leg of the terminal between the proximal end and the distal end to be flexibly movable into a slot in the housing during mating of the plug and receptacle connectors.

The free spring contact leg of the terminal includes a distal end that is based against a shoulder of the respective connector housing to "preload" the terminal thereby requiring minimal deflection of the terminal while at the same time providing adequate normal force thereof upon mating of the connectors. The terminal and housing design therefore permits use of a less stiff and thinner stock terminal material, thus reducing the cost and increasing the performance of the terminal and connector assembly.

The electrical connector assembly may include generally L-shaped retention members for securement of the connectors to the surface the printed circuit board, and holding members provided near opposite ends of the connector housings to removably retain the connectors in mated condition.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
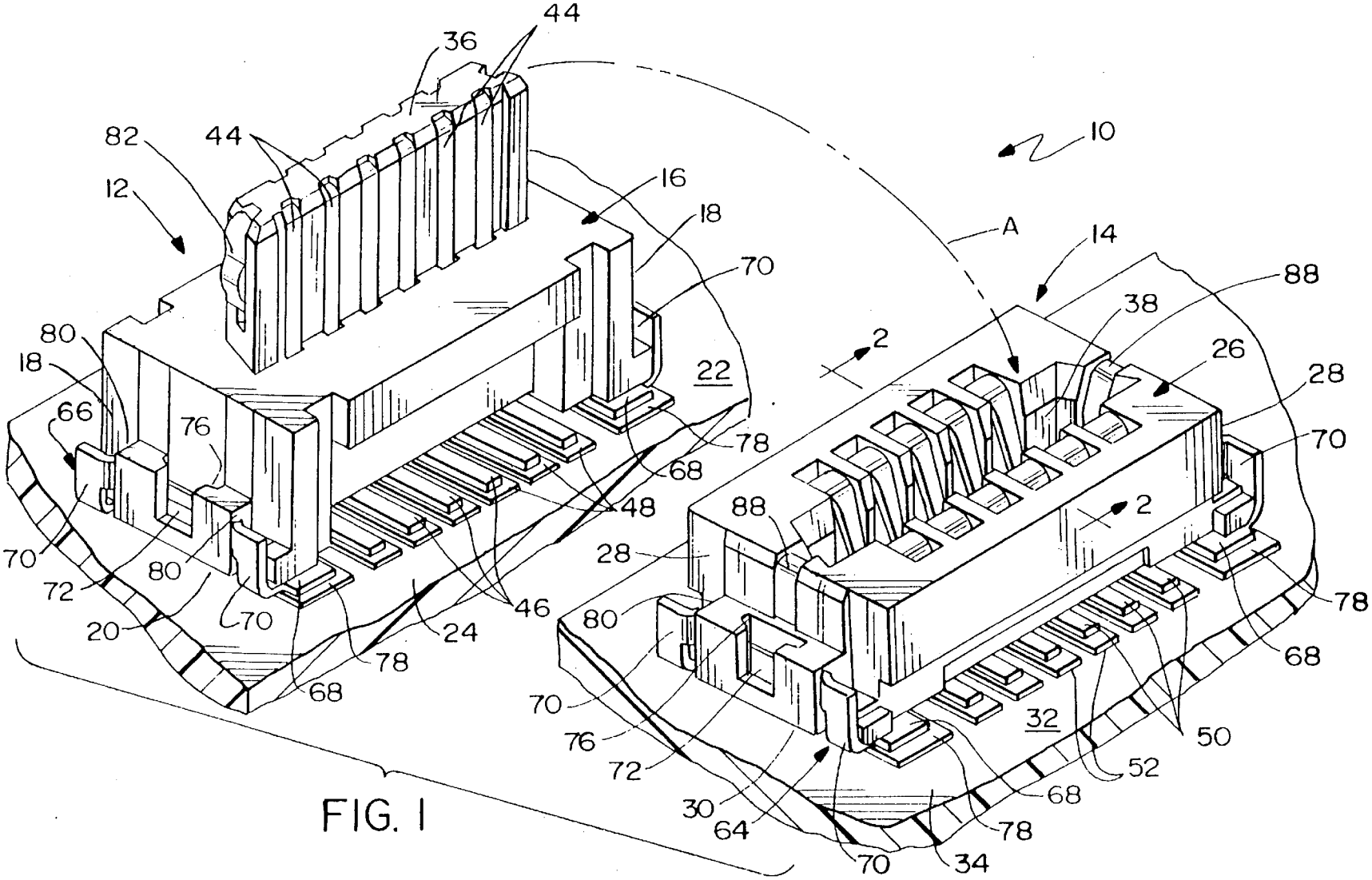
FIG. 1 is an exploded perspective view of the plug and receptacle connectors of the electrical connector assembly of the present invention, in an unmated condition.

Referring to the drawings in greater detail, and first to FIG. 1, the invention is embodied in a low profile electrical connector assembly, generally designated 10, which includes a plug connector, generally designated 12, that is mateable with a receptacle connector, generally designated 14. The plug connector includes a dielectric housing, generally designated 16, which has opposite ends 18 with a mounting face 20 extending therebetween and adapted for surface mounting to a surface 22 of a printed circuit board 24. Receptacle connector 14 includes a dielectric housing, generally designated 26, that has opposite ends 28 with a mounting face 30 extending therebetween and adapted for surface mounting to a surface 32 of a printed circuit board 34.

Figure 2:
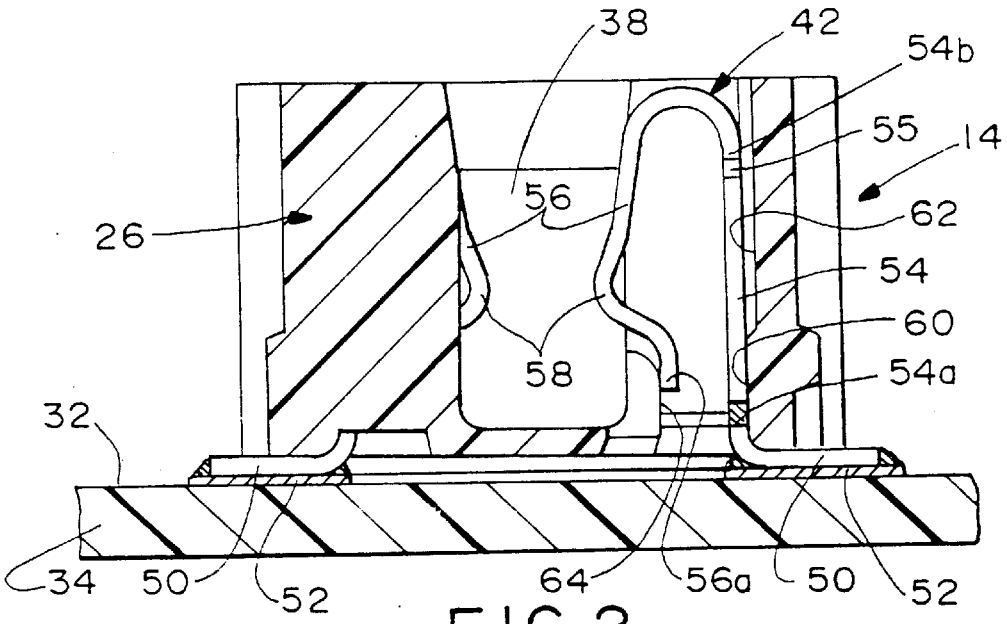
FIG. 2 is a vertical section taken generally along line 2—2 of FIG. 1.
Figure 3:
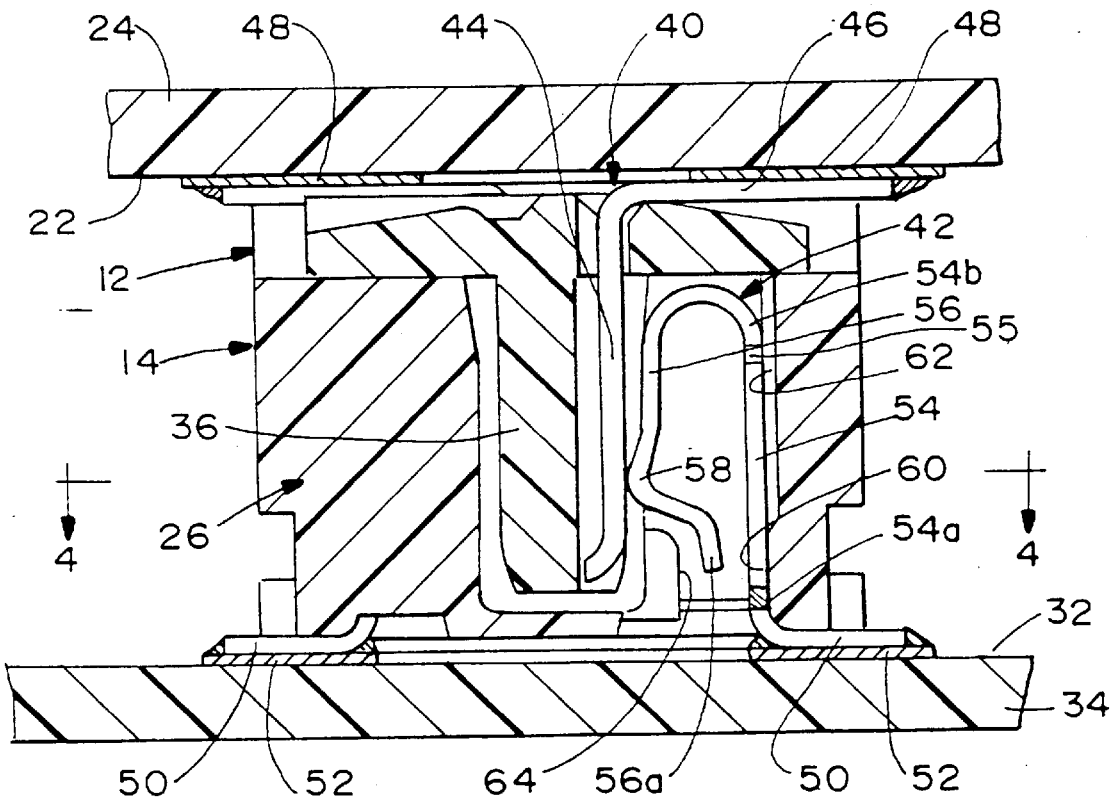
FIG. 3 is a vertical section similar to that of FIG. 2, but with the plug and receptacle connectors in a mated condition.

Referring to FIGS. 2 and 3 in conjunction with FIG. 1, plug connector 12 has a plug portion 36 which is mateable in the direction of phantom arrow "A" (FIG. 1) into a receptacle 38 of receptacle connector 14. Plug connector 12 mounts a plurality of terminals, generally designated 40 (FIG. 3), and receptacle connector 14 mounts a plurality of terminals, generally designated 42. As best seen in FIGS. 1 and 3, terminals 40 of plug connector 12 include blade-like contact portions 44 exposed on the sides of plug portion 36 and mounting portions 46 for surface connection to circuit traces 48 on surface 22 of printed circuit board 24. Terminals 40 of plug connector 12 are generally L-shaped and are disposed on opposite sides of plug portion 36 of the connector housing 16. The connector housing is unitarily molded of an insulative material, such as plastic or the like, and the terminals are stamped and formed of electrically conductive material.

Figure 8:
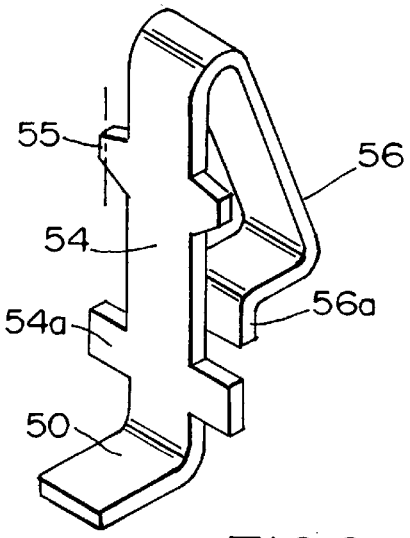
FIG. 8 is a perspective view of the receptacle terminal shown in FIGS. 4 and 6.

Terminals 42 of receptacle connector 14 are located on opposite sides of receptacle 38. Each terminal 42 has a mounting portion 50 for surface connection to a respective circuit trace 52 on surface 32 of printed circuit board 34. Each terminal 42 further includes a generally U-shaped contact portion defined by a first leg 54 that is joined to mounting portion 50 and a free spring contact leg 56 that includes a rounded contact portion 58 engageable with contact portion 44 of a respective plug connector terminal 40, as shown in FIG. 3. In essence, first leg 54 has a proximal end 54*a* that is fixed against a wall 60 (FIGS. 2 and 3) of receptacle connector housing 26 and a distal end 54*b* movably supported along its edges by tabs or flags 55 so that a portion of first leg 54 between distal end 54*b* and proximal end 54*a* is flexibly movable into a slot 62 in housing 26 upon deflection of rounded contact portion 58, while the bight portion of terminal 42 remains relatively stationary. This configuration allows for the distribution of stresses along first leg 54 of terminal 42, thereby providing improved deflection characteristics in the terminal, notwithstanding its short beam length due to the low profile of receptacle connector 14. Such improvement is achieved by the provision of the secondary support area at 55 to ensure that the entire terminal 42 is always under compression, rather than just fixing the terminal at a single fixed point (e.g., at 54*a*). The structure of terminal 42, and, in particular, the secondary support area 55 is shown clearly in FIG. 8 where the terminal is shown in perspective and removed from the housing. The lines in phantom represent the area where portions of the housing support the flags and prevent any movement of the first leg of the contact in a horizontal direction (i.e., parallel to surface mount foot 50). Like housing 16 and terminals 40 of plug connector 12, housing 26 is unitarily molded of an insulative material, such as plastic or the like, and terminals 42 are stamped and formed from a relatively thin stock (e.g., 0.15 mm) of electrically conductive material, such as phosphor bronze, which was heretofore deemed less suitable for low profile beams as discussed below.

Still referring to FIGS. 2 and 3, it can be seen that terminals 42 are "preloaded" within their respective terminal cavities in receptacle connector housing 26. In particular, it can be seen in FIG. 2 that a distal end 56*a* of leg 56 is spring-loaded or biased against a shoulder 64 of housing 26. When the connectors are mated as shown in FIG. 3, it can be seen that the distal end 56*a* of leg 56 has moved off of shoulder 64. The preloading thus requires minimal subsequent deflection of the terminal to achieve adequate contact normal force between the mating terminals since an opposing force is initially present at rounded contact portion 58 due to the preload. In addition, the presence of the preload helps reduce the angle of incidence between the mating plug and receptacle terminals, and thus reduces the force required to mate the connectors. This becomes more significant as the number of terminals, or circuits, increases per connector assembly. Not only do the lower forces allow for a more effortless mating of the plug and receptacle connectors, these lower forces in turn allow for more efficient assembly of the connectors by yielding a higher output and lower occurrence of damage to the assemblies than would occur if higher forces were needed. Furthermore, this allows the same low profile connector design to be used in the apparent trend of ever-increasing circuit sizes, which would not be possible if mating forces were excessive.

Figure 4:
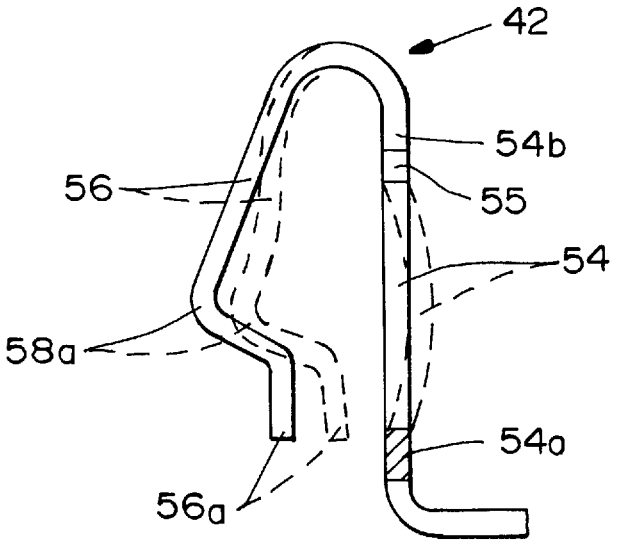
FIG. 4 is a view similar to that of FIG. 2, but with the receptacle terminal removed from the housing.
Figure 5:
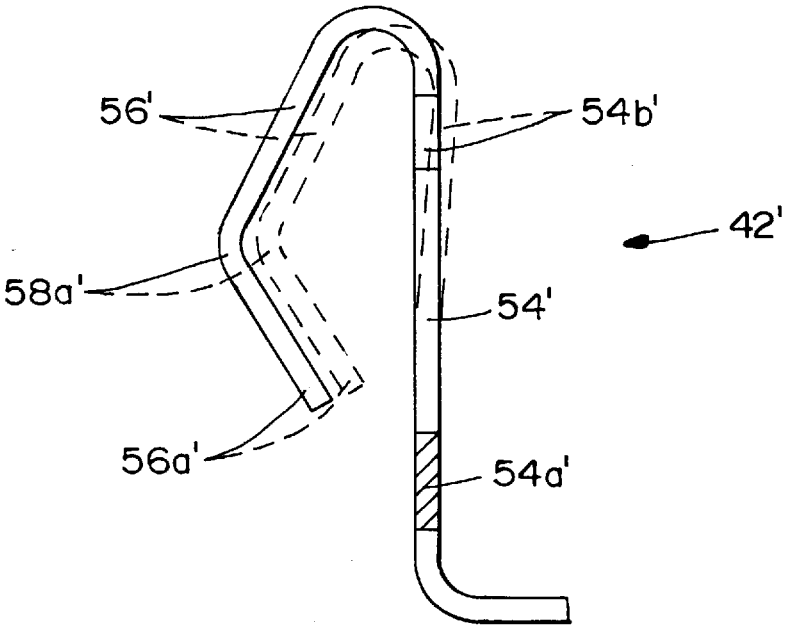
FIG.5 (PRIOR ART)
FIG. 5 is a view similar to that of FIG. 4 but of a prior art terminal.
Figure 6:
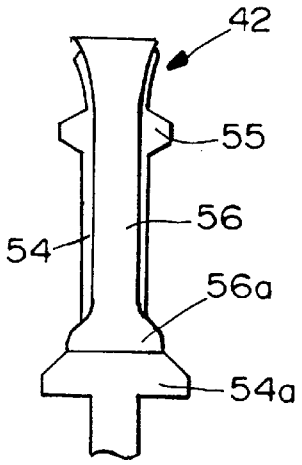
FIG. 6 is a front view of the receptacle terminal of FIG. 4.

Looking now to FIG. 4, although exaggerated for clarity and ease of understanding it can be seen that the operation of terminal 42 during mating of the connectors (as shown in phantom) is different from the operation of prior art terminal 42' of FIG. 5. Although the terminals shown are structurally distinctive, like reference numbers are used to refer to similar general features of the terminals for ease of comparison. As discussed above, the presence of flags 55 support distal end 54*b* of first leg 54 of terminal 42 thus preventing rearward movement (i.e., away from the applied force of a mating connector) of both the distal end of the first leg and the bight portion of terminal 42 during mating of the connectors, as occurs in prior art terminal 42' (as shown in phantom in FIG. 5). The behavior of prior art terminal 42' during deflection thereof actually results in stress within the terminal being concentrated at distal end 54*b'* and along the bight portion of the terminal between 54' and free spring contact leg 56'. Furthermore, the absence of a preload at distal end 56*a'* requires an increase in the deflection at contact portion 58' to yield adequate contact normal force. This concentration of stresses makes it necessary to use a stiffer and thicker and consequently more expensive contact material. For example, the prior art terminal uses a 0.2 mm thick beryllium copper contact and the preferred embodiment of the present invention utilizes a 0.15 mm thick phosphor bronze contact. Such differences can contribute significantly to the cost of the overall connector. FIG. 6 shows a front view of terminal 42 (looking from the left in FIG. 4) with flags 55 formed along the edges to support the terminal within the housing and hold it along a first direction generally parallel to mounting portion 50 while still allowing movement of the terminal in a direction parallel to first leg 54.

Figure 7:
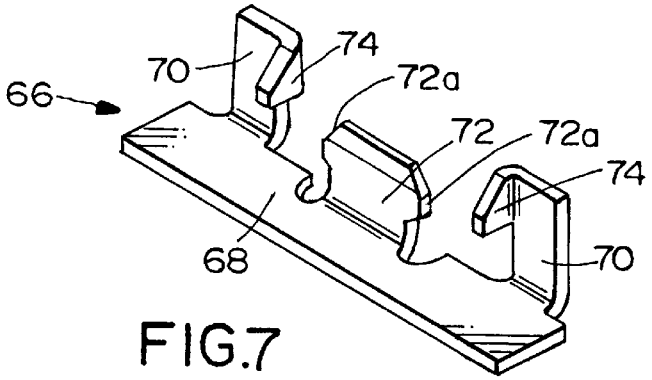
FIG. 7 is a perspective view of the L-shaped retention member of FIG. 1, removed from the housing

Referring back to FIG. 1, and also to FIG. 7 other features of the connector assembly may include a generally L-shaped retention member 66 mounted at each end 18 of plug connector housing 16 and each end 28 of receptacle connector housing 26. Each retention member includes a generally planar leg 68 adapted for securement to the surface of a respective underlying printed circuit board. Another leg is defined by outside arms 70 which are located on opposite side of an inside arm 72. Inside arm 72, and particularly edge portions 72*a*, (FIG. 7) of retention members 66 maintain an inference fit within passages 76 in the respective housing, after being inserted through the respective mounting faces 20 and 30 thereof, to securely fix the retention members in the housings. Legs 68 of the retention members are surface secured, as by soldering, to solder pads 78 on the printed circuit boards to both relieve the stress at the terminal solder joints and to provide additional retention of the surface mount plug and receptacle connector to their respective circuit boards. Furthermore, in order to reinforce the retention of the retention members within the respective connector housings, oppositely facing ears 74 (FIG. 7) of the retention members abut against oppositely facing shoulders 80 of the respective connector housings. Since each retention member 66 is stamped and formed of conductive material, the retention members may be soldered to a respective grounding circuit of the respective printed circuit board, and then coupled upon mating, thus resulting in the assemblies, and their respective systems, being at a common potential.

Complementary interengaging holding members may also be provided near opposite ends of connector housings 16 and 26 of plug connector 12 and receptacle connector 14, respectively, for removably retaining the connectors in mated condition. The holding members are stamped and formed of sheet metal material whereby, during mating of connectors 12 and 14, radiused projections on each of the holding members may give a tactile or audible indication that the connectors are mated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A low profile surface mountable electrical connector assembly comprising:

a plug and receptacle connector having mating dielectric housings each mounting a plurality of terminals which include contact portions for interengagement with the contact portions of the terminals of the other connector, the housing of each connector having opposite ends with a mounting face extending therebetween and adapted for surface mounting to a surface of a printed circuit board, the terminals including surface mounting portions extending generally parallel to the surface of the printed circuit board for surface connection to circuit traces on the board;

at least one of the terminals of at least one of the connectors including a generally U-shaped contact defined by a first leg joined to the respective surface mounting portion of the terminal and a free spring contact leg engageable with the contact portion of one of the terminals of the other connector, the first leg having a proximal end fixed to the housing proximate the surface mounting portion of the terminal and a distal end opposite the proximal end movably supported in a first direction within the housing generally parallel to the surface mounting portions such that, upon interengagement of the contact portions of the plug and receptacle connectors, the first lea of the U-shaped contact can move only in a direction generally perpendicular to the, first direction, whereby a portion of the first leg of the terminal between the proximal end and the distal end is flexibly movable away from the free spring contact leg into a slot of the housing; and preloading means between the free spring contact leg of said U-shaped contact portion and the respective connector housing for preloading the contact portion and providing an opposing force within the free spring contact leg prior to mating the connectors.

2. The low profile surface mountable electrical connector assembly as set forth in claim 1 wherein said preloading means comprises a shoulder on the respective connector housing engageable by a distal end of the free spring contact leg and wherein, upon interengagement of the contact portions of the plug and receptacle connectors, the distal end of the free spring contact leg is spaced from the shoulder of the connector housing.

3. The low profile surface mountable electrical connector assembly as set forth in claim 1 further comprising a stamped and formed retention member mounted at each end of each connector housing for securing the connector to its respective printed circuit board, each retention member being generally L-shaped with a first leg attached to the respective end of one of the housings and a second leg adapted for surface securement to said one surface of the printed circuit board.

4. The low profile surface mountable electrical connector assembly as set forth in claim 3 further comprising stamped and formed holding members near the opposite ends of the connector housings for removably retaining the connectors in mated condition.

5. A low profile surface mountable receptacle connector for mounting on the surface of a printed circuit board, comprising:

a elongated receptacle housing mounting a plurality of terminals, each terminal including a surface mounting portion for surface connection to circuit traces on the board, a generally U-shaped contact defined by a first leg joined to the surface mounting portion and a free spring contact leg having a contact portion engageable with a contact portion of a mating connector, the first leg having a proximal end fixed to the housing proximate the surface mounting portion and a distal end opposite the proximal end movably supported in a first direction within the housing generally parallel to the surface mounting portions such that, upon interengagement of the contact portion of the free spring contact leg with the contact portion of the mating connector, the first leg of the U-shaped contact is substantially moveable in a second direction only, generally perpendicular to the first direction, whereby a portion of the first leg of the terminal between the proximal end and the distal end is flexibly movable away from the free spring contact leg in the first direction into a slot of the housing.

6. The low profile surface mountable receptacle connector as set forth in claim 5 further comprising preloading means between the free spring contact leg of said U-shaped contact and the housing for preloading the contact by providing an opposing force within the free spring contact leg prior to deflection of the terminal.

7. The low profile surface mountable receptacle connector as set forth in claim 6 wherein said preloading means comprises a shoulder on the receptacle connector housing engageable by a distal end of the free spring contact leg and wherein, upon interengagement of the contact portion of the free spring contact leg with the contact portion of the mating connector, the distal end of the free spring contact leg is spaced from the shoulder of the connector housing.

8. A surface mountable terminal for mounting within a housing of a low profile electrical connector assembly adapted to be mounted to the surface of a printed circuit board comprising:

a surface mounting portion extending generally parallel to the surface of the printed circuit board and adapted for surface connection to circuit traces on the board;

a generally U-shaped contact defined by a first leg extending generally perpendicular to the circuit board and joined to the respective surface mounting portion of the terminal, a free spring contact leg adapted for engagement and deflection by a mating terminal, and a bight portion extending between the first leg and the free spring contact leg, wherein the first leg of the contact includes a proximal end fixed to the housing proximate the surface mounting portion of the terminal and a distal end supported in a single horizontal direction within the housing proximate the bight portion such that the first leg, upon deflection of the free spring contact leg, can only move in a vertical direction, whereby a portion of the first leg of the contact between the proximal end and the distal end is flexibly movable into a slot of the housing in the horizontal direction upon deflection of the free spring contact leg.

9. The surface mountable terminal as set forth in claim 1 further comprising a preload means at a distal end of the free spring contact leg of the U-shaped contact for providing an opposing force within the free spring contact leg prior to engagement of the mating terminal, wherein the preload means is engageable by a shoulder on the connector housing and is deflected away from said shoulder during engagement of the mating terminal.

10. The surface mountable terminal as set forth in claim 1 wherein the distal end of the first leg of the U-shaped contact further is supported by outwardly extending tabs which support the distal end of the first leg in a direction generally parallel to the surface mount portion and which allow for flexible movement of the first leg of the contact between the proximal end and the distal end only in a direction generally parallel to the surface mount portion during engagement by the mating terminal, whereby the uni-directional support of the tabs allows for the distribution of stresses along the first leg to provide improved deflection characteristics in the terminal.

* * * * *